US012240027B2

(12) United States Patent
Akiyama

(10) Patent No.: US 12,240,027 B2
(45) Date of Patent: Mar. 4, 2025

(54) PRESS BRAKE

(71) Applicant: AMADA CO., LTD., Kanagawa (JP)

(72) Inventor: Shogo Akiyama, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 235 days.

(21) Appl. No.: 18/007,932

(22) PCT Filed: Jun. 7, 2021

(86) PCT No.: PCT/JP2021/021479

§ 371 (c)(1),
(2) Date: Dec. 2, 2022

(87) PCT Pub. No.: WO2021/256305

PCT Pub. Date: Dec. 23, 2021

(65) Prior Publication Data

US 2023/0241659 A1 Aug. 3, 2023

(30) Foreign Application Priority Data

Jun. 15, 2020 (JP) ..... 2020-102874

(51) Int. Cl.
*B21D 5/02* (2006.01)
*B21D 43/26* (2006.01)

(52) U.S. Cl.
CPC ..... *B21D 5/02* (2013.01); *B21D 43/26* (2013.01)

(58) Field of Classification Search
CPC ..... B21D 5/02; B21D 5/0281; B21D 5/002
See application file for complete search history.

(56) References Cited

U.S. PATENT DOCUMENTS 5,410,904 A * 5/1995 Hirata ..... B21D 5/002 72/461
6,212,933 B1 * 4/2001 Aoki ..... B21D 5/002 72/461

FOREIGN PATENT DOCUMENTS

JP 5-84520 A 4/1993
JP 7-26012 U1 5/1995
JP 2001-62515 A 3/2001
JP 2010162558 A * 7/2010

(Continued)

OTHER PUBLICATIONS

Extended European Search Report for corresponding EP Application No. 21825449.8 issued Nov. 2, 2023.

(Continued)

*Primary Examiner* — Debra M Sullivan
(74) *Attorney, Agent, or Firm* — Renner, Otto, Boisselle & Sklar, LLP

(57) ABSTRACT

A press brake includes elevating members each provided to respective one of a pair of support blocks so as to be able to ascend and descend, and extending vertically. A ball screw is provided to a first elevating member so as to be rotatable, and a nut member to be screwed into the ball screw is provided to a first support block. One end side of a stretch in the lateral direction is connected to an upper end portion of the first elevating member, and the other end side of the stretch in the lateral direction is connected, so as to be rotationally movable, to an upper end portion of a second elevating member. A support mechanism for supporting the stretch from below is provided to the first elevating member, and an abutting member is provided to the stretch.

3 Claims, 8 Drawing Sheets

(56) References Cited

FOREIGN PATENT DOCUMENTS

JP 2019-130535 A 8/2019

OTHER PUBLICATIONS

International Search Report for corresponding Application No. PCT/JP2021/021479, mailed Aug. 24, 2021.
Written Opinion for corresponding Application No. PCT/JP2021/021479, mailed Aug. 24, 2021.

* cited by examiner

PRESS BRAKE

TECHNICAL FIELD

The present invention relates to a press brake that bends a plate-shaped workpiece (a sheet metal) by the collaboration between an upper tool and a lower tool.

BACKGROUND ART

A press brake is provided with a back gauge device for positioning a workpiece in the front-rear direction with respect to a lower tool (see Patent Literatures 1 to 3). The outline of the configuration of the back gauge device will be described below.

A pair of support blocks separated in the lateral direction are provided on the back side of a lower table in a main frame, and the pair of support blocks are first and second support blocks. Elevating members extending vertically are provided to the respective support blocks so as to be able to ascend and descend, and the pair of elevating members are first and second elevating members. Further, a stretch extending in the lateral direction is provided between the upper end portion of the first elevating member and the upper end portion of the second elevating member. One end side of the stretch in the lateral direction is fixed to the upper end portion of the first elevating member, and the other end side of the stretch in the lateral direction is fixed to the upper end portion of the second elevating member. Further, a plurality of abutting members are provided to the stretch, and each of the abutting members includes an abutting surface, on the distal end side thereof, against which the end surface of the plate-shaped workpiece can be abutted. Each of the abutting members is configured to be movable in the lateral direction and the front-rear direction with respect to the main frame. The abutting surface of each of the abutting members is positioned at a height position corresponding to the height of the lower tool by an elevating operation of the pair of elevating members.

The back gauge device is divided into a first type that performs the elevating operation of the pair of elevating members by driving two motors (see Patent Literature 1 and Patent Literature 2), and a second type that performs the elevating operation of the pair of elevating members by driving one motor (see Patent Literature 3). Since the number of motors is reduced in the second type back gauge device, the cost of the press brake can be lowered as compared with the first type back gauge device. Among the configurations of the second type back gauge device, the configuration for ascending and descending the pair of elevating members will be described below.

Ball screws (screw bolts in Patent Literature 3) extending vertically are provided to respective ends of the stretch in the lateral direction so as to be hanged down. A nut member is provided on the upper end side of each of the elevating members (upper and lower guide pins in Patent Literature 3) via a separate member (a front-rear moving beam member in Patent Literature 3), and each of the nut members is screwed into each of the ball screws. A motor (a servo motor for vertical movement in Patent Literature 3), which causes a pair of nuts to be rotated, is provided on the upper end side of the first elevating member. An output shaft of the motor is interlocked and connected to the pair of nut members via a chain or a timing belt.

CITATION LIST

Patent Literature

Patent Literature 1: Japanese Patent Application Laid-open Publication No. 2010-162558

Patent Literature 2: Japanese Patent Application Laid-open Publication No. 2019-130535

Patent Literature 3: Japanese Patent Application Laid-open Publication No. 5-84520

SUMMARY

The second type back gauge device includes the pair of ball screws and the pair of nut members. In other words, the second type back gauge device includes two ball screw mechanisms for elevation, each of which includes the ball screw and the nut member. Therefore, in the second type back gauge device, adjustment for synchronizing the two ball screw mechanisms for elevation is required, which causes a problem that the adjustment work of the back gauge device requires a lot of time and effort.

A press brake according to an embodiment of the present invention includes a pair of support blocks provided on a back side of a lower table in a main frame and separated in a lateral direction, elevating members each provided to respective one of the pair of support blocks so as to be able to ascend and descend and extending vertically, a ball screw provided so as to be rotatable to a first elevating member of a pair of the elevating members or a first support block of the pair of support blocks, extending vertically, and configured to be rotated by a driving of a motor, and a nut member provided to the first support block or the first elevating member and screwed into the ball screw. The press brake according to the present embodiment includes a stretch extending in the lateral direction, one end side of the stretch in the lateral direction being connected to an upper end portion of the first elevating member and the other end side of the stretch in the lateral direction being connected to an upper end portion of a second elevating member of the pair of elevating members, an abutting member provided to the stretch, the abutting member including, on a distal end side, an abutting surface against which an end surface of a plate-shaped workpiece can be abutted, the abutting member being configured to be movable in the front-rear direction with respect to the main frame, and a support mechanism provided to the first elevating member so as to support the stretch from below.

Here, the pair of support blocks, the pair of elevating members, the stretch, the support mechanism, and the abutting member constitute a part of a back gauge device for positioning a workpiece in the front-rear direction with respect to a lower tool installed on the lower table.

According to the above configuration, as described above, the one end side of the stretch in the lateral direction is connected to the upper end portion of the first elevating member. The other end side of the stretch in the lateral direction is connected to the upper end portion of the second elevating member. The support mechanism that supports the stretch from below is provided to the first elevating member. Therefore, by providing only one ball screw mechanism for elevation, which includes the ball screw and the nut member, to the back gauge device, the pair of elevating members can be ascended and descended by the driving of one motor.

Therefore, it is possible to simplify the adjustment work of the back gauge device while reducing the cost of the press brake.

DESCRIPTION OF EMBODIMENT

Figure 1:
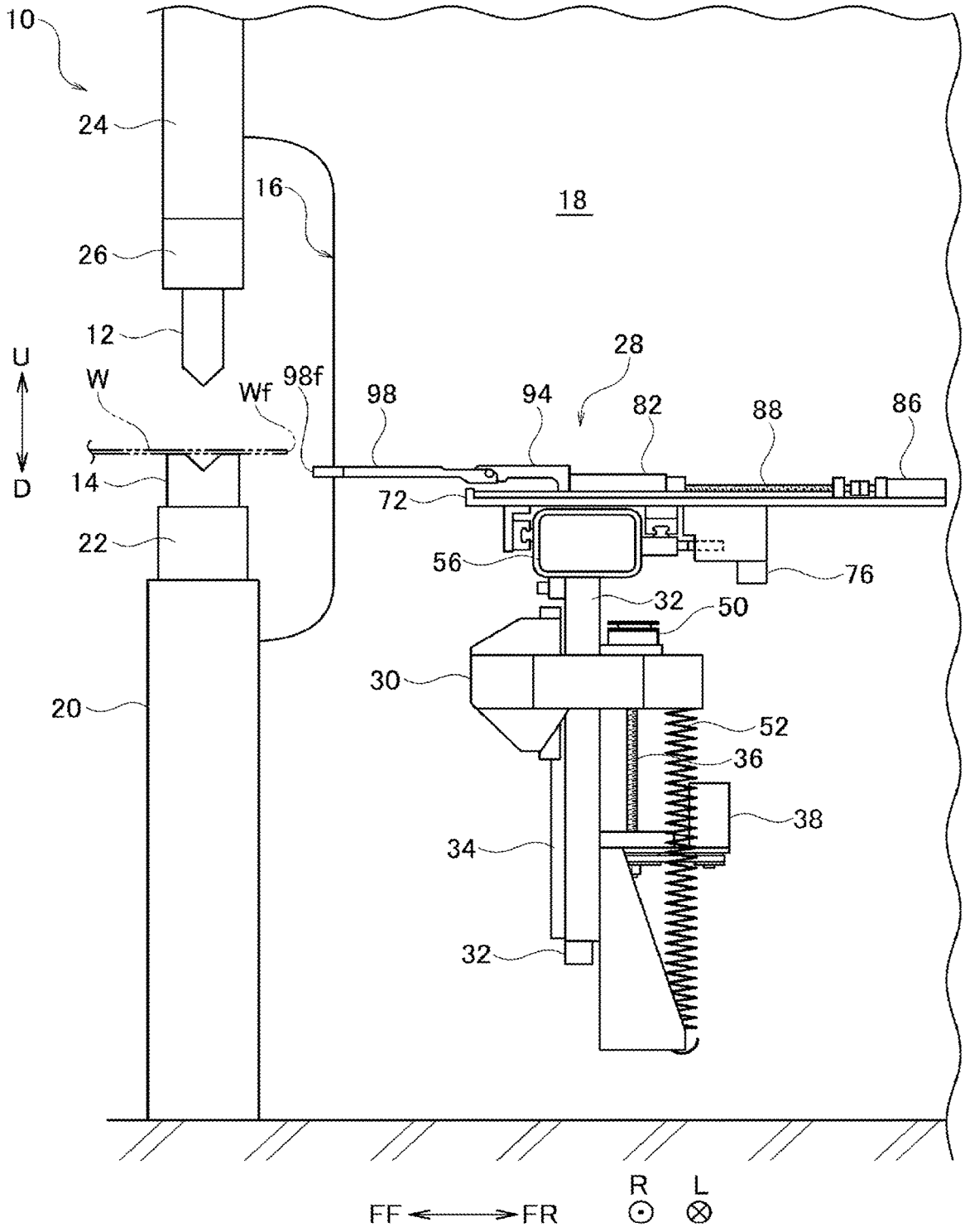
FIG. 1 is a schematic partial cross-sectional view of a press brake according to the present embodiment.
Figure 2:
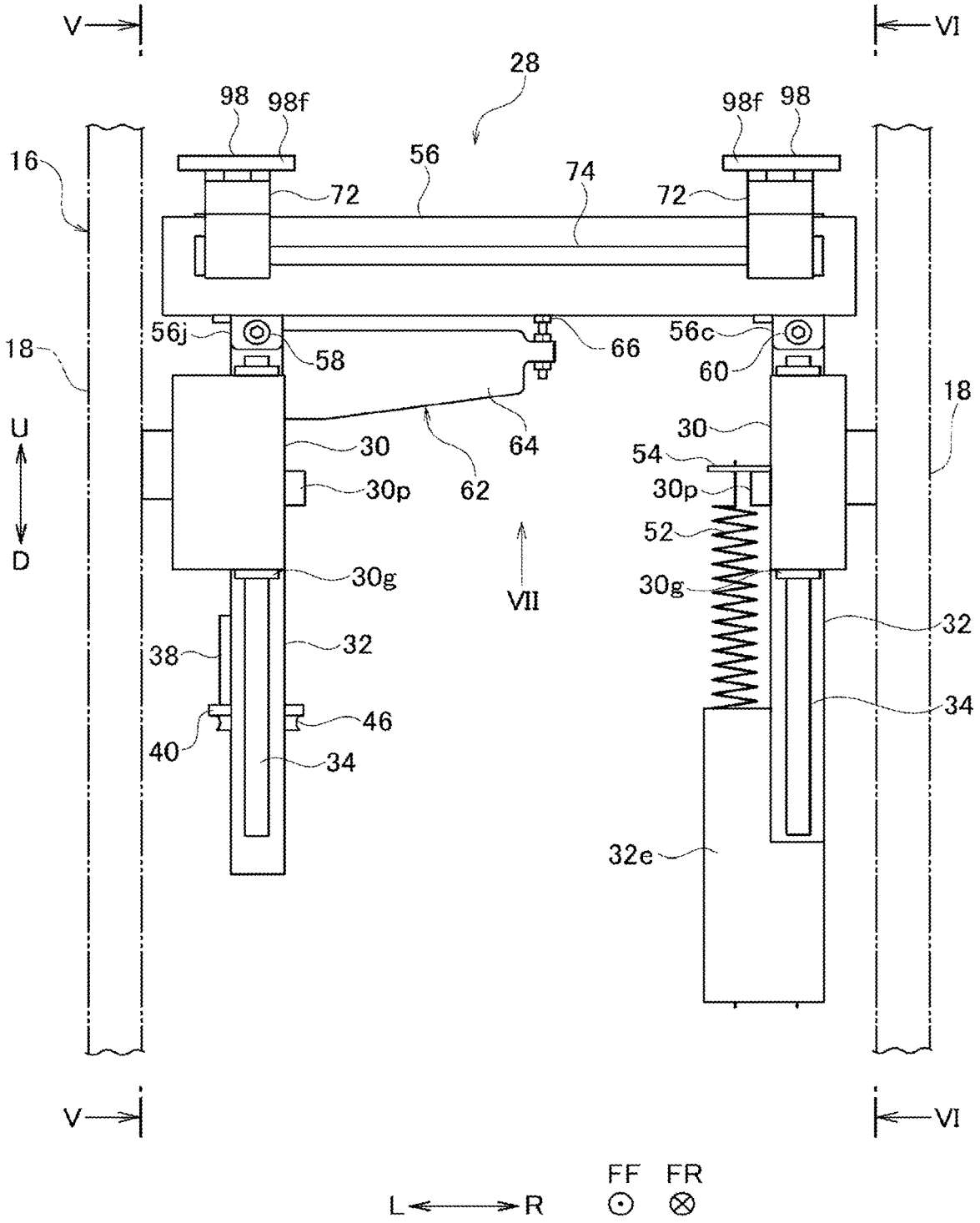
FIG. 2 is a front view of the back gauge device according to the present embodiment.

Hereinafter, the present embodiment will be described with reference to FIGS. 1 to 8.

Note that in the description and the claims of the present application, the term "provided" means not only directly provided but also indirectly provided via another member. The term "lateral direction" is one of the horizontal directions, which is a lateral direction of the press brake, and is also referred to as the Y-axis direction. The phrase "inside in the lateral direction" means the center side of the press brake in the lateral direction. The term "front-rear direction" is a horizontal direction orthogonal to the lateral direction, which is a depth direction of the press brake, and is also referred to as the L-axis direction. In the drawings, "FF" indicates the front direction, "FR" indicates the rear direction, "L" indicates the left direction, "R" indicates the right direction, "U" indicates the upward direction, and "D" indicates the downward direction.

As shown in FIG. 1, a press brake 10 according to the present embodiment is a working machine that bends a plate-shaped workpiece (a sheet metal) W by the collaboration between an upper tool (punch tool) 12 and a lower tool (die tool) 14. The press brake 10 includes with a main frame 16, and the main frame 16 includes a pair of side plates 18 that are separated and opposed to each other in the lateral direction, and a plurality of connecting members (not shown) that integrally connect the pair of side plates 18. The pair of side plates 18 are first (left side) and second (right side) side plates 18.

A lower table 20 extending in the lateral direction is provided at the lower part of the front surface side (the front side) of the main frame 16. A lower tool holder 22, which retains the lower tool 14 so as to be installable and removeable, is provided on the upper side of the lower table 20. Further, an upper table 24 extending in the lateral direction is provided at the upper part of the front surface side of the main frame 16 so as to be able to ascend and descend (so as to be vertically movable). The upper table 24 is ascended and descended by the driving of an elevating hydraulic cylinder (not shown) or an elevating motor (not shown) as an elevating actuator for a table provided at an appropriate position on the main frame 16. An upper tool holder 26, which retains the upper tool 12 so as to be installable and removable, is provided on the lower side of the upper table 24. In lieu of configuring the upper table 24 so as to be able to ascend and descend, the lower table 20 may be configured so as to be able to ascend and descend.

A back gauge device 28 for positioning the workpiece W in the front-rear direction with respect to the lower tool 14 is provided on the back side (the rear side) of the lower table 20 in the main frame 16. In the schematic partial cross-sectional view of FIG. 1, the back gauge device 28 provided inside in the lateral direction of the second (right side) side plate 18 is illustrated on the back side (the rear side) of the lower table 20. The specific configuration of the back gauge device 28 will be described below.

As shown in FIGS. 1 to 6, a pair of support blocks (guide blocks) 30, which are separated and opposed to each other in the lateral direction, are provided on the back side of the lower table 20 in the main frame 16. The pair of support blocks 30 are first (left side) and second (right side) support blocks 30. The first support block 30 is fixed to the first side plate 18, and the second support block 30 is fixed to the second side plate 18. Each of the support blocks 30 has, on the back side thereof, a guide portion 30*g* extending vertically. Each of the support blocks 30 includes, inside in the lateral direction thereof, a protrusion 30*p* that protrudes in the rear direction. Further, an elevating member 32 extending vertically is provided via a slide rail 34 to the guide portion 30*g* of each of the support blocks 30 so as to be able to ascend and descend. The pair of elevating members 32 are first (left side) and second (right side) elevating members 32. The first elevating member 32 includes, on the back side thereof, two protrusions 32*p* and 32*b* that are vertically separated. The second elevating member 32 includes, on the lower end side thereof, an extending portion 32*e* extending downward. Note that the drawings of the present application show, as an example, a state in which the pair of elevating members 32 are positioned at the lowest position.

A ball screw 36 extending vertically is provided between the two protrusions 32*p* and 32*b* of the first elevating member 32 so as to be rotatable. An elevating motor 38 that causes the ball screw 36 to rotate is provided, via a bracket 40, to the protrusion 32*b* of the first elevating member 32. An output shaft of the elevating motor 38 is interlocked and connected to the ball screw 36 via two pulleys 42 and 44 and a timing belt 46. The ball screw 36 is ascended and descended while being rotated by the driving of the elevating motor 38. Further, a nut member 48 screwed into the ball screw 36 is provided to the protrusion 30*p* of the first support block 30. The back gauge device 28 includes one ball screw mechanism for elevation, which includes the ball screw 36 and the nut member 48. Note that in lieu of providing the ball screw 36 to the first elevating member 32 so as to be rotatable, the ball screw 36 may be provided to the first support block 30 so as to be rotatable. In this case, the nut member 48 is provided not to the first support block 30 but to the first elevating member 32.

An electromagnetic brake 50 that secures the ball screw 36 in a nonrotatable manner is provided to the protrusion 32*p* of the first elevating member 32. The electromagnetic brake 50 is configured to secure the ball screw 36 by a braking force in a nonrotatable manner when the power of the press brake 10 is turned off. Note that the electromagnetic brake 50 is a body separated from the elevating motor 38, but the elevating motor 38 may include the electromagnetic brake. The back gauge device 28 may include another brake (not shown) that secures the ball screw 36 in a nonrotatable manner in lieu of the electromagnetic brake 50.

A plurality of tension springs 52 are provided in parallel between the protrusion 30*p* of the second support block 30 and the extending portion 32*e* of the second elevating member 32, as balancers that reduce gravity acting on the second elevating member 32. The plurality of tension springs 52 are urging members that urge the second elevating member 32 upward. The upper end portion of each of the tension springs 52 is locked to the protrusion 30*p* of the second support block 30 via a bracket 54, and the lower end portion of each of the tension springs 52 is locked to the lower end portion of the extending portion 32*e* of the second elevating member 32.

As shown in FIGS. 5 to 8, a square pipe-shaped stretch 56 extending in the lateral direction is provided between the upper end portion of the first elevating member 32 and the upper end portion of the second elevating member 32. The stretch 56 includes connecting portions 56*j* and 56*c* on one end side and the other end side in the lateral direction thereof, respectively. The connecting portion 56*j* of the stretch 56 is connected, so as to be rotationally movable (swingable), to the upper end portion of the first elevating member 32 via a first connecting bolt 58 as a first connecting pin. The first connecting bolt 58 is screwed into the upper end portion of the first elevating member 32. The connecting portion 56*c* of the stretch 56 is connected, so as to be rotationally movable, to the upper end portion of the second elevating member 32 via a second connecting bolt 60 as a second connecting pin. The second connecting bolt 60 is screwed into the upper end portion of the second elevating member 32.

A support mechanism 62 that supports the stretch 56 from below is provided on the upper end side of the first elevating member 32. The support mechanism 62 includes a support base 64 provided on the upper end side of the first elevating member 32 and extending inside in the lateral direction. The support mechanism 62 includes an adjusting screw 66 that is provided by being screwed into a distal end portion of the support base 64 and that contacts (supports) the stretch 56 from below, and upper and lower lock nuts 68 and 70 that prevent the adjusting screw 66 from being loosened. The support mechanism 62 adjusts levelness of the stretch 56 when the stretch 56 moves rotationally around the first connecting bolt 58.

Figure 3:
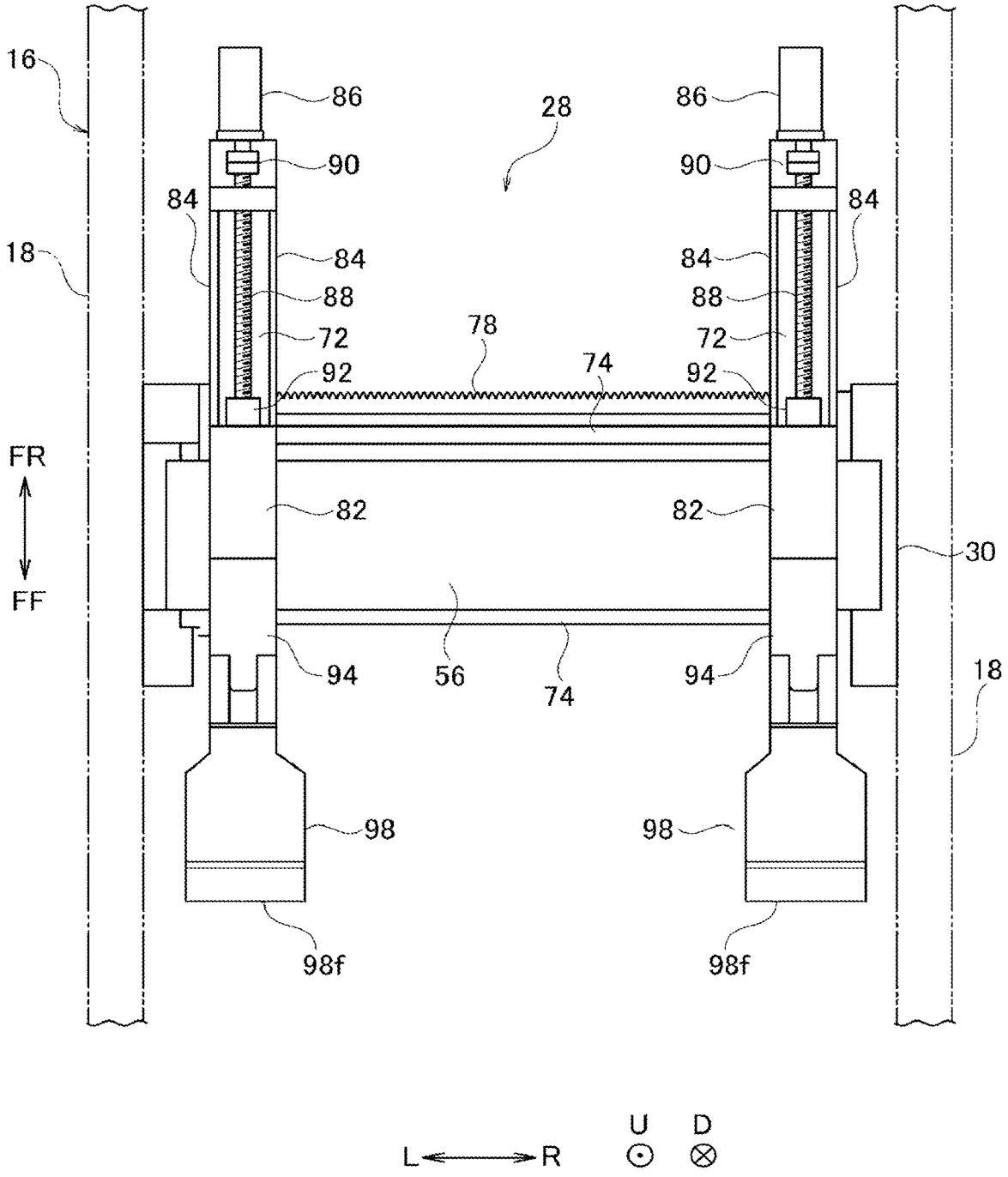
FIG. 3 is a plan view of the back gauge device according to the present embodiment.
Figure 4:
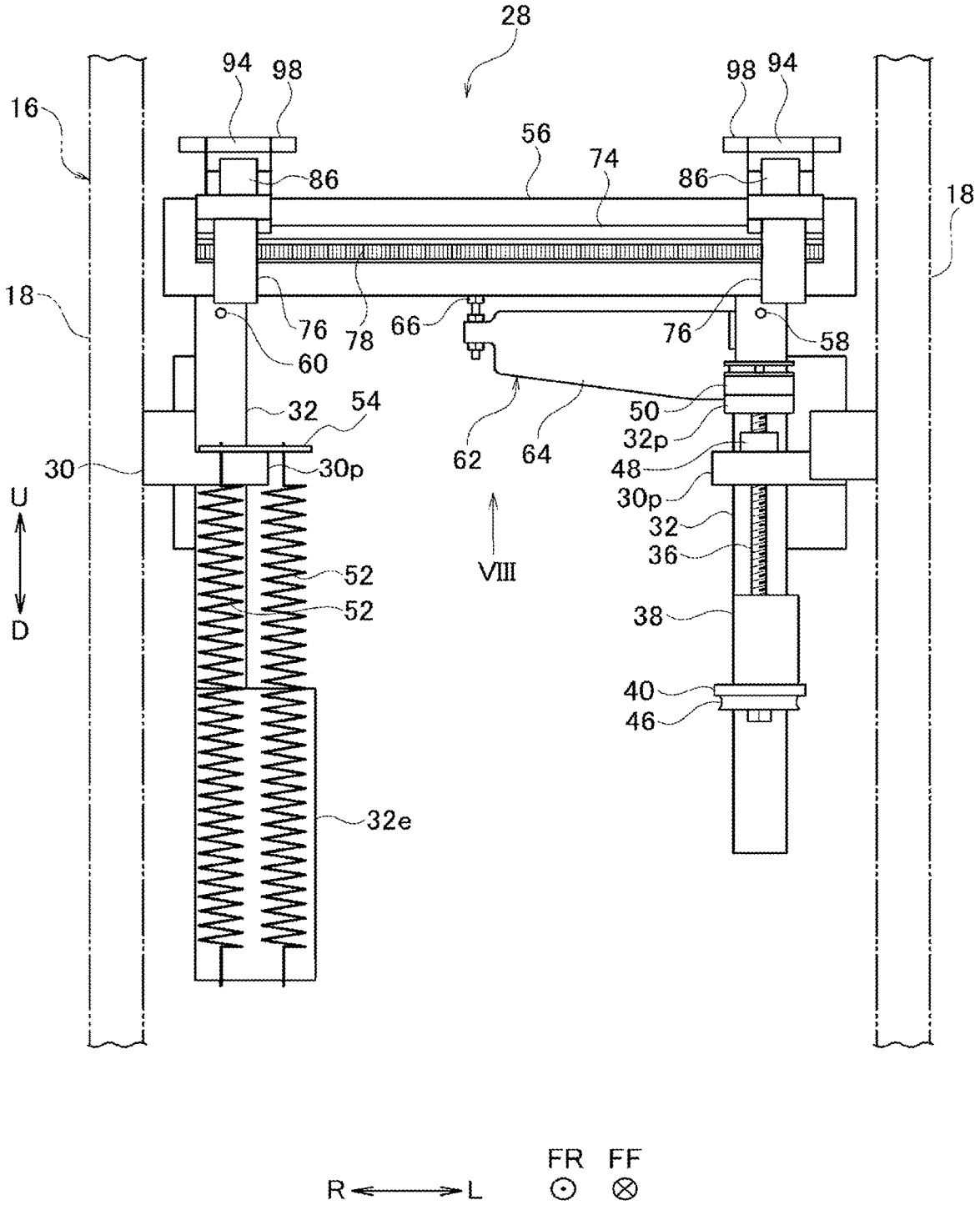
FIG. 4 is a rear view of the back gauge device according to the present embodiment.
Figure 5:
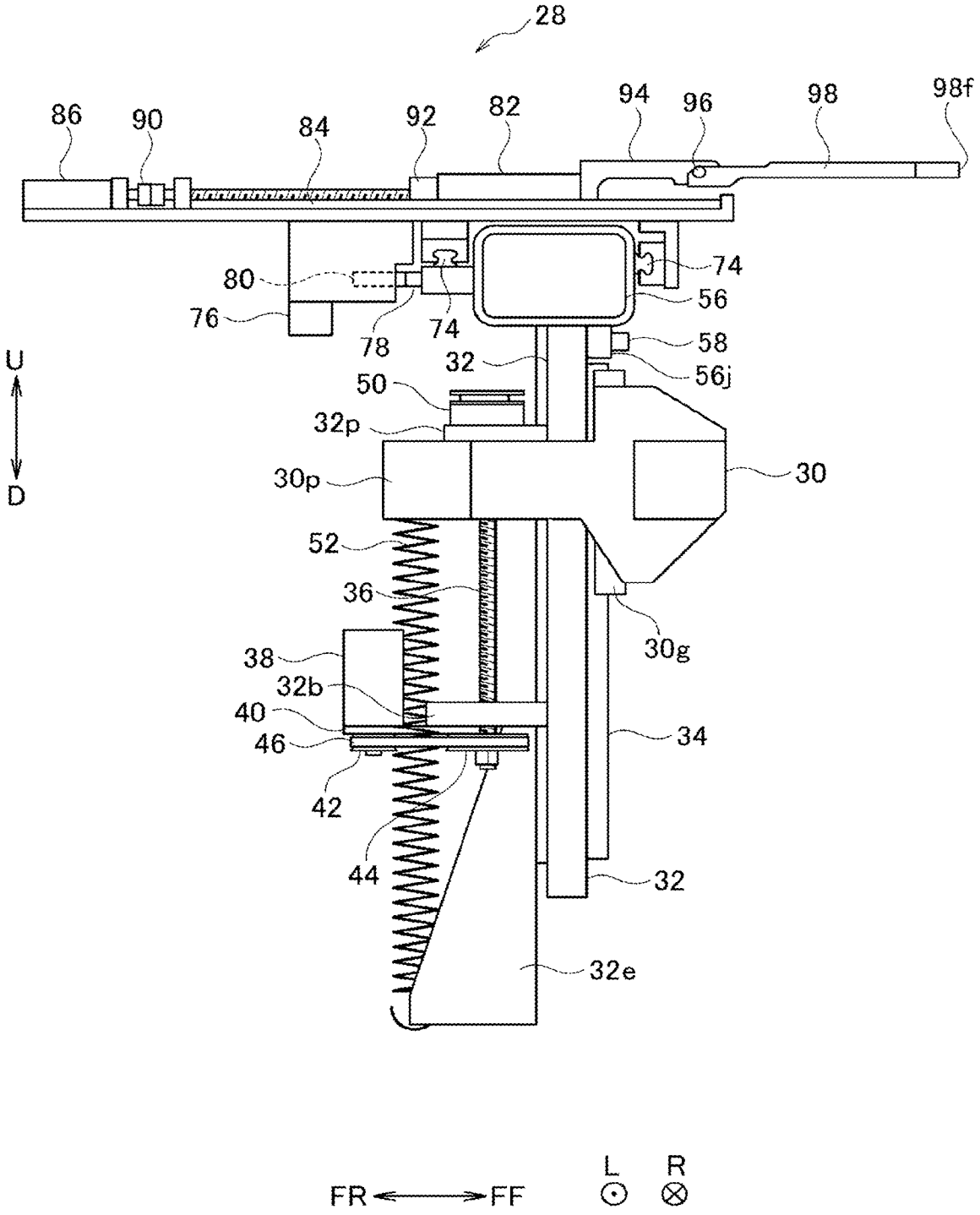
FIG. 5 is a diagram taken along the V-V line in FIG. 2.
Figure 6:
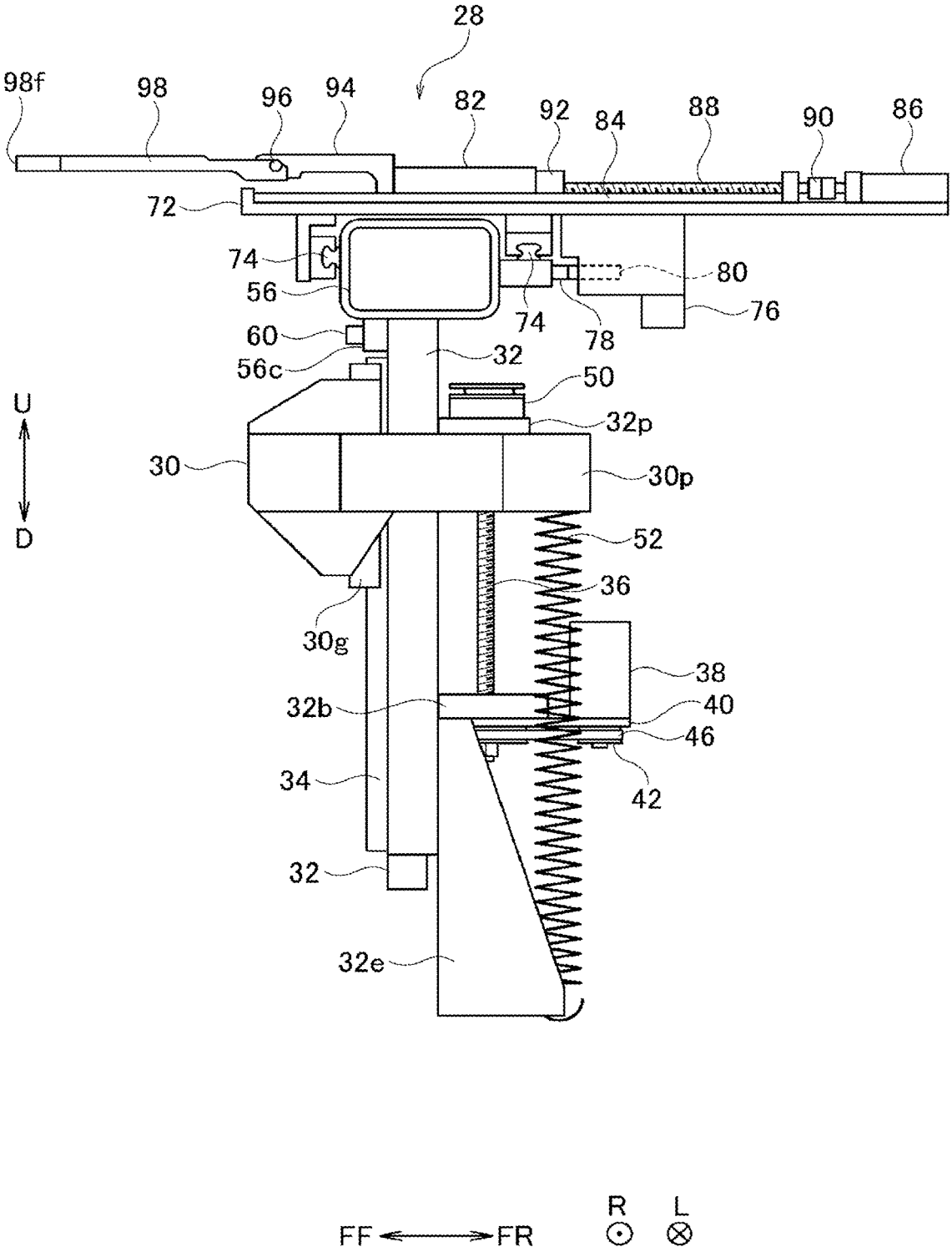
FIG. 6 is a diagram taken along the VI-VI line in FIG. 2.
Figure 7:
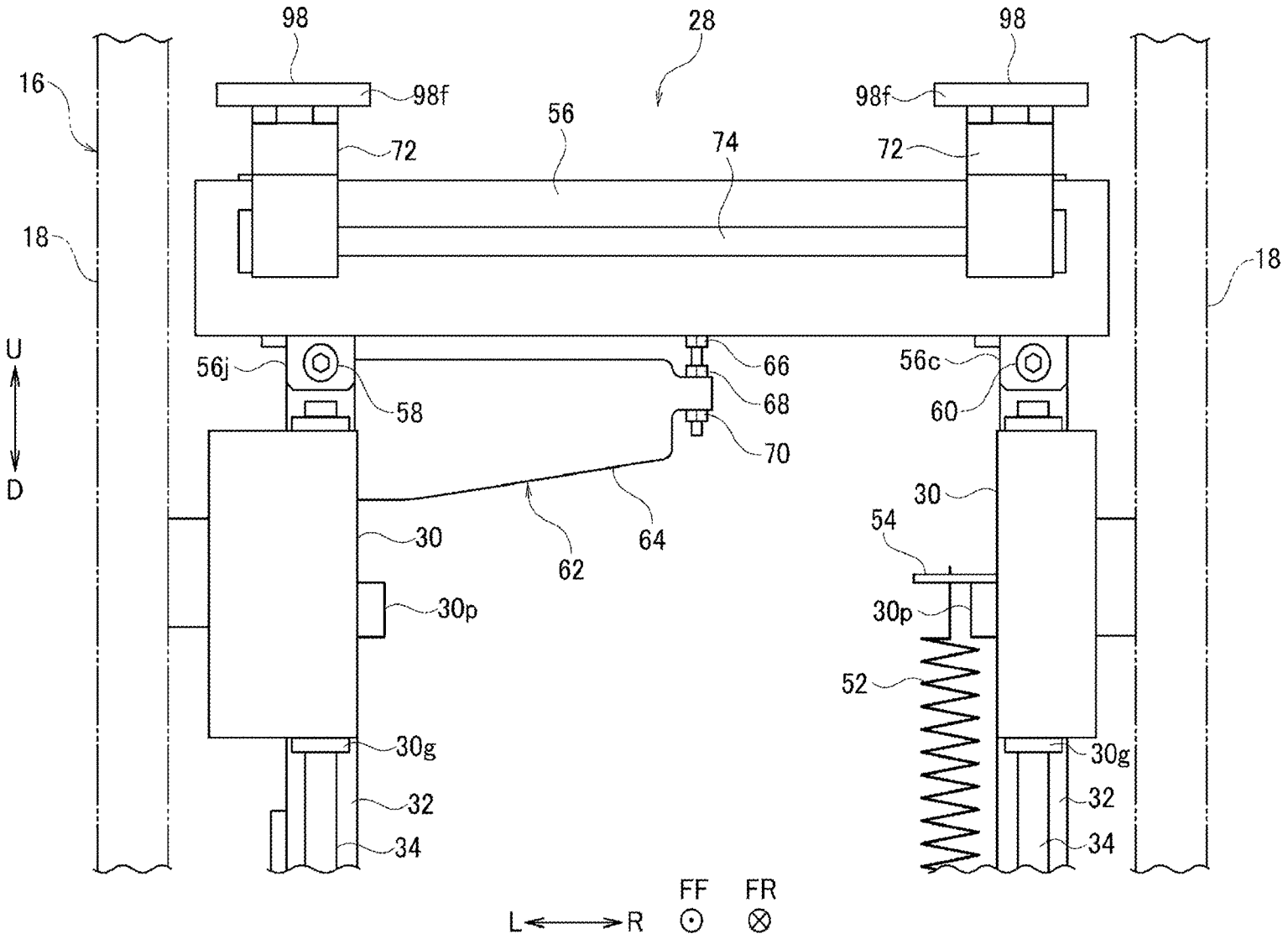
FIG. 7 is an enlarged view of the VII portion in FIG. 2.
Figure 8:
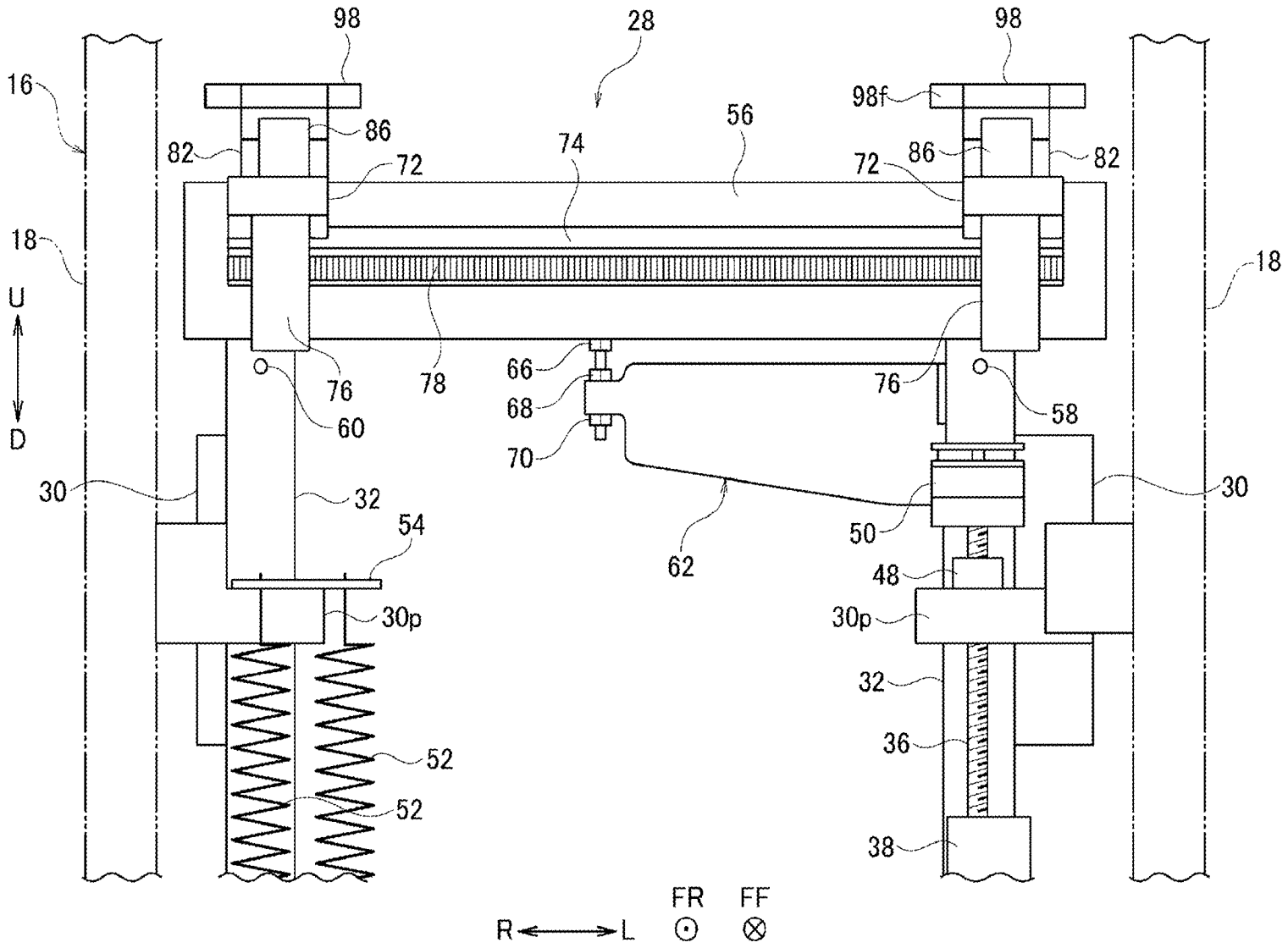
FIG. 8 is an enlarged view of the VIII portion in FIG. 4.

As shown in FIGS. 3, 5, and 6, a pair of Y-axis sliders 72 is provided to the stretch 56 so as to be movable in the lateral direction via a plurality of guide rails 74. Each of the Y-axis sliders 72 extends in the front-rear direction. A Y-axis motor 76, which causes each of the Y-axis sliders 72 to move in the lateral direction with respect to the stretch 56, is provided on the back side of each of the Y-axis sliders 72. A rack member 78 extending in the lateral direction is provided on the back surface of the stretch 56. A pinion 80 is provided to an output shaft of each of the Y-axis motors 76, and each of the pinions 80 is engaged with the rack member 78. Note that as an example, the drawings of the present application show a state in which the pair of Y-axis sliders 72 are most separated in the lateral direction.

An L-axis slider 82 is provided on the upper surface of each of the Y-axis sliders 72 so as to be movable in the front-rear direction via a pair of guide rails 84. An L-axis motor 86, which causes each of the L-axis sliders 82 to move in the front-rear direction with respect to each of the Y-axis sliders 72, is provided at the rear end portion of each of the Y-axis sliders 72. A ball screw 88 extending in the front-rear direction is provided on the upper surface of each of the Y-axis sliders 72 so as to be rotatable, and each of the ball screws 88 is interlocked and connected to an output shaft of each of the L-axis motors 86 via a coupling 90. A nut member 92 is provided to the rear end portion of each of the L-axis sliders 82, and each of the nut members 92 is screwed into each of the ball screws 88.

As shown in FIGS. 1, 5, and 6, an abutting base 94 is provided on the upper surface of each of the L-axis sliders 82, and a mounting shaft 96 is provided to a distal end portion of each of the abutting bases 94. An abutting member 98, which has a known configuration that is shown in Patent Literature 2, is provided to each of the mounting shafts 96. In other words, the pair of abutting members 98 are provided to the stretch 56 via the pair of Y-axis sliders 72, the pair of L-axis sliders 82, and the like. Each of the abutting members 98 includes, on a distal end side thereof, an abutting surface 98*f* against which an end surface Wf of the workpiece W can be abutted. Each of the abutting members 98 is configured to be movable in the lateral direction and the front-rear direction with respect to the main frame 16. Each of the abutting members 98 moves in the lateral direction integrally with the Y-axis slider 72 with respect to the main frame 16 by the driving of the Y-axis motor 76. Each of the abutting members 98 moves in the front-rear direction integrally with the L-axis slider 82 with respect to the main frame 16 by the driving of the L-axis motor 86. Each of the abutting members 98 is configured to be able to be installed to and removed from each of the mounting shafts 96 and to be able to be folded up with an axial center of each of the mounting shafts 96 as a center.

Subsequently, the operation and effect of the press brake 10 according to the present embodiment will be described.

(Normal Action of Press Brake 10)

The pair of elevating members 32 are ascended and descended by the driving of the elevating motor 38. Thereby, the stretch 56 is ascended and descended integrally with the pair of elevating members 32, which causes the abutting surface 98*f* of each of the abutting members 98 to be positioned at a height position corresponding to the lower tool 14. Further, each of the abutting members 98 is moved in the lateral direction integrally with each of the Y-axis sliders 72 by the driving of each of the Y-axis motors 76. Thereby, the interval in the lateral direction between the pair of abutting members 98 is adjusted according to a bending length of the workpiece W. Further, each of the abutting members 98 is moved in the front-rear direction integrally with each of the L-axis sliders 82 by the driving of each of the L-axis motors 86, which causes the abutting surface 98*f* of each of the abutting members 98 to be positioned at a predetermined position in the front-rear direction.

After that, the workpiece W is moved in the rear direction and the end surface Wf of the workpiece W is abutted against the abutting surfaces 98*f* of the pair of abutting members 98. Thereby the workpiece W is positioned in the front-rear direction with respect to the lower tool 14. Then, the upper table 24 is lowered, which causes the workpiece W to be bent by the collaboration between the upper tool 12 and the lower tool 14. At this time, since each of the abutting members 98 is folded up with the axial center of each of the mounting shafts 96 as a center, it is possible to prevent damage to the abutting member 98 and the like, which is caused by the folding-up of the workpiece W. Note that after the workpiece W is bent, the upper table 24 is raised to return to the original state.

(Specific Action of Press Brake 10)

In the press brake 10, as described above, the connecting portion 56*j* of the stretch 56 is connected, so as to be rotationally movable, to the upper end portion of the first elevating member 32 via the first connecting bolt 58. The connecting portion 56*c* of the stretch 56 is connected, so as to rotationally movable, to the upper end portion of the second elevating member 32 via the second connecting bolt 60. The second connecting bolt 60 is screwed into the upper end portion of the second elevating member 32. The support mechanism 62 that supports the stretch 56 from below is provided on the upper end side of the first elevating member 32. The plurality of tension springs 52 that reduce the gravity acting on the second elevating member 32 are provided in parallel between the protrusion 30*p* of the second support block 30 and the extending portion 32*e* of the second elevating member 32. Therefore, by providing only one ball screw mechanism for elevation, which includes the ball screw 36 and the nut member 48, to the back gauge device 28, the pair of elevating members 32 can be ascended and descended by the driving of one elevating motor 38.

Prior to bending of the workpiece W, the power of the press brake 10 is turned off and the ball screw 36 is secured in a nonrotatable manner by the electromagnetic brake 50. Then, the stretch 56 is moved rotationally around the first connecting bolt 58 so that the stretch 56 becomes level by a rotary operation of the adjusting screw 66 in a state in which the gravity acting on the second elevating member 32 is reduced by the plurality of tension springs 52. As a result, the levelness of the stretch 56 can be easily adjusted.

(Effect of Press Brake 10)

According to the present embodiment, as described above, by providing only one ball screw mechanism for elevation to the back gauge device 28, the pair of elevating members 32 can be ascended and descended by the driving of one elevating motor 38 and the levelness of the stretch 56 can be easily adjusted. Therefore, according to the present embodiment, it is possible to simplify the adjustment work of the back gauge device 28 while reducing the cost of the press brake 10.

Note that the present invention is not limited to the description of the present embodiment described above, and can be carried out in various other aspects by making appropriate changes, such as configuring each of the support blocks 30 so as to be movable in the front-rear direction with respect to the main frame 16. Then, the scope of rights included in the present invention is not limited to the description of the present embodiment described above.

The entire contents of Japanese Patent Application No. 2020-102874 (application date: Jun. 15, 2020) are incorporated herein.

The invention claimed is:

1. A press brake, comprising:

a pair of support blocks provided on a back side of a lower table in a main frame and separated in a lateral direction;

elevating members each provided to respective one of the pair of support blocks so as to be able to ascend and descend and extending vertically;

a ball screw provided so as to be rotatable to a first elevating member of a pair of the elevating members or a first support block of the pair of support blocks, extending vertically, and configured to be rotated by a driving of a motor;

a nut member provided to the first support block or the first elevating member and screwed into the ball screw;

a stretch extending in the lateral direction, one end side of the stretch in the lateral direction being connected to an upper end portion of the first elevating member and another end side of the stretch in the lateral direction being connected to an upper end portion of a second elevating member of the pair of elevating members;

an abutting member provided to the stretch, the abutting member including, on a distal end side, an abutting surface against which an end surface of a plate-shaped workpiece can be abutted, the abutting member being configured to be movable in a front-rear direction with respect to the main frame;

a support mechanism provided to the first elevating member so as to support the stretch from below; and a brake configured to secure the ball screw in a nonrotatable manner, wherein one end side of the stretch in the lateral direction is connected to an upper end portion of the first elevating member via a first connecting pin so as to be rotationally movable, and another end side of the stretch in the lateral direction is connected to an upper end portion of the second elevating member via a second connecting pin so as to be rotationally movable, and the support mechanism includes a support base provided to the first elevating member, and an adjusting screw provided by being screwed into the support base so as to contact the stretch from below.

2. The press brake according to claim 1, further comprising a balancer for reducing gravity acting on the second elevating member.

3. The press brake according to claim 2, wherein the balancer is an urging member provided between the second support block of the pair of support blocks and the second elevating member, and configured to urge the second elevating member upward.

* * * * *